US009765575B2

(12) United States Patent
Hradecky et al.

(10) Patent No.: US 9,765,575 B2
(45) Date of Patent: Sep. 19, 2017

(54) ELECTRICAL BULKHEAD CONNECTOR

(71) Applicant: Impact Selector, Inc., Heath, TX (US)

(72) Inventors: Jason Allen Hradecky, The Woodlands, TX (US); John Hall, Houston, TX (US)

(73) Assignee: Impact Selector International, LLC, Houma, LA (US)

( * ) Notice: Subject to any disclaimer, the term of this patent is extended or adjusted under 35 U.S.C. 154(b) by 377 days.

(21) Appl. No.: 14/460,409

(22) Filed: Aug. 15, 2014

(65) Prior Publication Data

US 2015/0047854 A1 Feb. 19, 2015

Related U.S. Application Data

(60) Provisional application No. 61/866,368, filed on Aug. 15, 2013.

(51) Int. Cl.

| | |
|---|---|
| ***E21B 17/02*** | (2006.01) |
| ***E21B 33/038*** | (2006.01) |
| ***H01R 13/533*** | (2006.01) |
| *H01R 13/52* | (2006.01) |

(52) U.S. Cl.

CPC ..... *E21B 17/028* (2013.01); *E21B 33/0385* (2013.01); *H01R 13/533* (2013.01); *H01R 13/5208* (2013.01)

(58) Field of Classification Search

CPC . E21B 17/023; E21B 33/0385; H01R 13/523; H01R 13/521; E21E 17/028

See application file for complete search history.

(56) References Cited

U.S. PATENT DOCUMENTS

| | | | | | |
|---|---|---|---|---|---|
| 2,297,828 | A * | 10/1942 | Flatford | E21B 17/028 | 174/50 |
| 2,700,140 | A * | 1/1955 | Phillips | H01R 9/032 | 174/77 R |
| 4,053,196 | A * | 10/1977 | Dunaway | H01R 13/523 | 29/854 |
| 4,193,655 | A * | 3/1980 | Herrmann, Jr. | H01R 13/502 | 439/166 |
| 5,362,258 | A * | 11/1994 | Arnswald | H01R 13/521 | 439/271 |
| 6,062,905 | A * | 5/2000 | Sampa | E21B 17/028 | 439/587 |
| 6,481,495 | B1 * | 11/2002 | Evans | E21B 17/003 | 166/178 |

(Continued)

*Primary Examiner* — Kipp Wallace

(74) *Attorney, Agent, or Firm* — Boisbrun Hofman, PLLC

(57) ABSTRACT

A bulkhead connector assembly for assembly within a downhole tool to isolate a dry side of the downhole tool from a fluid side of the downhole tool and to allow electrical communication therebetween. The bulkhead connector assembly comprises a bulkhead comprising holes extending therethrough, wherein the bulkhead is adapted to form a fluid seal against an inside surface of the downhole tool. Terminals extend through the bulkhead, wherein an end of each terminal is in electrical communication with one of a plurality of electrical wires. Boots each extend about the end of a corresponding one of the terminals. A retaining block has holes each receiving one of the boots. A housing positioned around the retaining block is coupled to the bulkhead, thus positionally fixing the retaining block relative to the bulkhead.

17 Claims, 4 Drawing Sheets

(56) References Cited

U.S. PATENT DOCUMENTS

| | | | | |
|---|---|---|---|---|
| 8,485,837 | B2 * | 7/2013 | Head | E21B 17/028 166/66 |
| 2013/0102176 | A1 * | 4/2013 | Kazubowski | H01R 13/512 439/275 |

* cited by examiner

ELECTRICAL BULKHEAD CONNECTOR

CROSS-REFERENCE TO RELATED APPLICATIONS

This application claims priority to and the benefit of U.S. Provisional Application No. 61/866,368, entitled "Multi-Pin Boot Retainer," filed Aug. 15, 2013, the entire disclosure of which is hereby incorporated herein by reference.

BACKGROUND OF THE DISCLOSURE

Drilling operations have become increasingly expensive as the need to drill deeper, in harsher environments, and through more difficult materials have become reality. Additionally, testing and evaluation of completed and partially finished well bores has become commonplace, such as to increase well production and return on investment.

In working with deeper and more complex wellbores, it becomes more likely that tools, tool strings, and/or other downhole apparatus may break down or become inoperable within the bore. Furthermore, downhole tools are regularly subjected to high temperatures, temperature changes, high pressures, and the other rigors of the downhole environment. Internal components of the downhole tools may be subjected to repeated stresses that may compromise reliability. In addition to the potential to damage equipment in trying to retrieve it, the construction and/or operation of the well must generally stop while tools are retrieved from the bore.

Consequently, internal electrical components of a downhole tool, such as an impact jar tool, may become damaged or otherwise stop working, requiring the tool to be retrieved from the bore. For example, connections between electrical sockets and terminals may be severed due to retainer boots becoming disconnected from the terminals. This problem is often associated with air-to-fluid terminals on electrical bulkhead connectors usable for isolating fluid and dry sides of the downhole tool.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
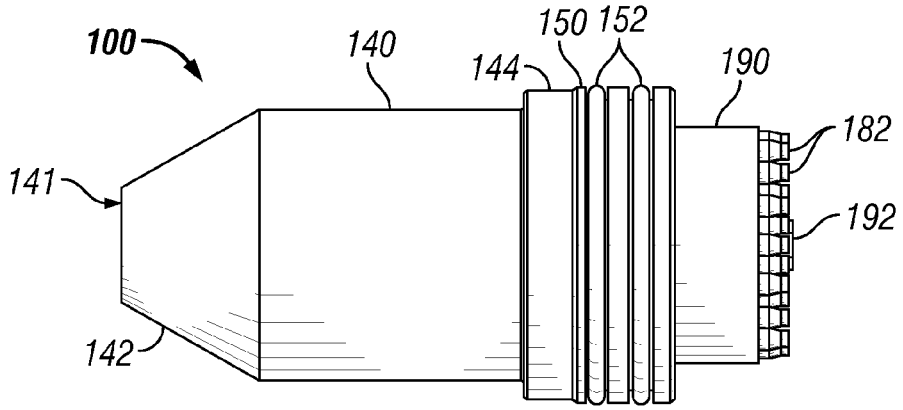
FIG. 1 is a schematic view of at least a portion of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

Figure 2:
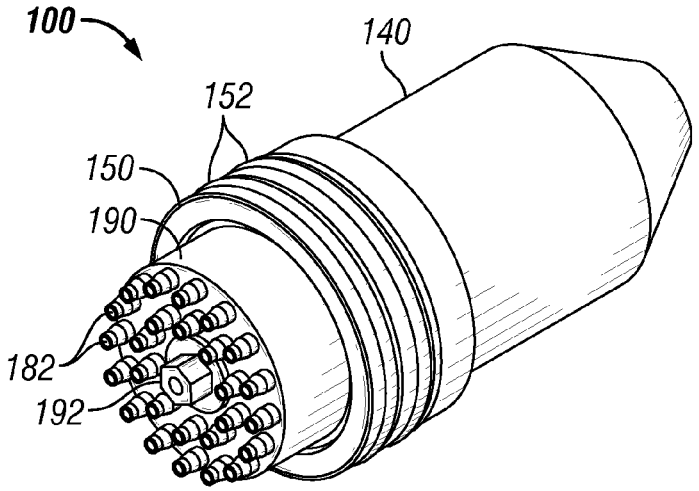
FIG. 2 is a perspective view the apparatus shown in FIG. 1.
Figure 3:
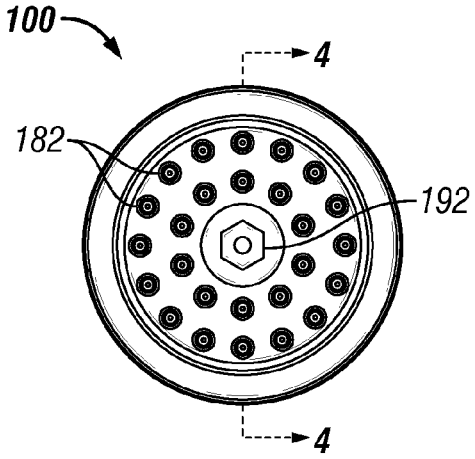
FIG. 3 is an end view the apparatus shown in FIG. 1.
Figure 4:
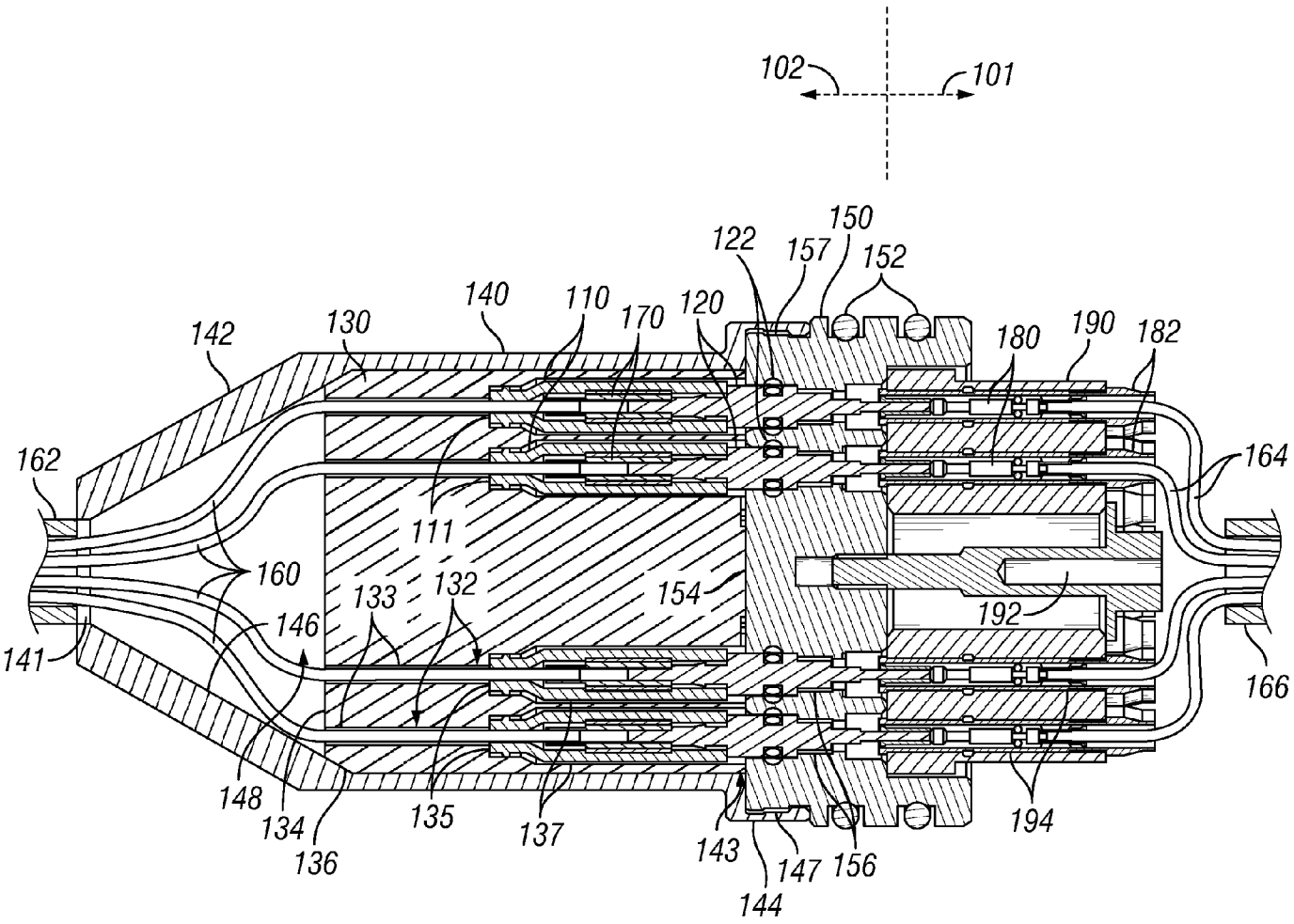
FIG. 4 is a sectional view the apparatus shown in FIG. 1.

The present disclosure relates generally to at least a portion of an electrical transmission, connector, and/or cable assembly of a downhole tool. The present disclosure introduces an apparatus 100 that is or comprises an electrical bulkhead connector usable in a downhole tool. FIGS. 1-4 each show different views of the apparatus. FIG. 1 is a plan view, FIG. 2 is a perspective view, FIG. 3 is an end view, and FIG. 4 is a sectional view taken along the lines 4-4 in FIG. 3.

The apparatus 100 is or comprises a bulkhead connector assembly operable within an impact jar and/or other downhole tool to isolate a dry side 101 of the apparatus 100 within the downhole tool from a fluid side 102 of the apparatus 100 within the downhole tool, and to enable electrical communication therebetween. The dry side 101 and fluid side 102 may be reversed in other implementations within the scope of the present disclosure.

The apparatus 100 may comprise multiple conductor ("multi-pin") boot retaining features that may, for example, aid in preventing disconnection of one or more boots 110 from one or more electrical terminals 120 by, for example, restricting movement of the boots 110 relative to one or more other components of the apparatus 100. The apparatus 100 may comprise a universal or custom bulkhead 150 having a generally cylindrical configuration adapted for insertion into an internal cavity of a downhole tool 500 (see FIG. 5). The following description refers to FIGS. 1-5 collectively.

The bulkhead 150 may comprise a predetermined number of holes 156 extending therethrough for receiving air-to-fluid electrical terminals 120 therein. When inserted into the holes 156, first ends of the terminals 120 extend into the dry side 101 of the apparatus 100 (which may also be referred to herein as the dry side of the downhole tool 500), while second ends of the terminals 120 extend into the fluid side 102 of the tool 500 (which may also be referred to herein as the dry side of the downhole tool 500). The example implementation of the bulkhead 150 depicted in FIGS. 1-5 accepts 26 terminals 120, although other numbers and/or types of terminals are also within the scope of the present disclosure. The terminals 120 may be sealed in corresponding holes 156 of the bulkhead 150, perhaps with corresponding O-rings and/or other fluid sealing members 122, such as to reduce or prevent fluid communication between opposing sides of the bulkhead 150. An outer circumferential surface 157 of the bulkhead 150 may comprise external threads, grooves, and/or other means for engaging a bell housing 140. The bulkhead 150 may also carry one or more O-rings and/or other sealing members 152, such as may further affect fluidic isolation of opposing sides of the apparatus 100. For example, the sealing members 152 may each form a fluid seal against an inside surface of the downhole tool 500 to reduce or prevent fluid communication between opposing sides of the bulkhead 150.

The apparatus 100 may further comprise a retaining block 130 for positioning over the boots 110 and a bell housing 140 for maintaining the retaining block 130 in position with respect to the bulkhead 150. The retaining block 130 may have a generally cylindrical configuration and a plurality of specially designed holes 132 for accepting individual boots 110 therein. For example, the holes 132 may have a narrower portion 133, a wider portion 137, and a shoulder 135 that transitions or extends between the narrower and the wider portions of each hole 132. The retaining block 130 may also or alternatively provide insulation assurance in the area between first ends of the terminals 120 and the electrical wires 160 collectively extending from a first multi-wired cable or a pigtail 162. The first end 134 of the retaining block 130 may have a tapered or otherwise shaped surface 136 that may cooperate with a corresponding tapered or otherwise shaped internal surface 146 of the bell housing 140. The retaining block 130 may substantially comprise PEEK and/or other plastic materials.

The bell housing 140 is shown as a generally cylindrical member with a central cavity 148 extending therethrough. The first end 142 of the bell housing 140 may include a conical portion having a tapered internal surface 146 and a first hole extending into the internal cavity 148. The second end 144 of the bell housing 140 may include internal threads 147 for engaging the external threads 157 of the bulkhead 150 and a second hole 143 extending into the internal cavity 148. The second hole 143 has a sufficient size to accommodate the retaining block 130 therethrough. Once the retaining block 130 is positioned within the bell housing 140, the bell housing 140 may be threaded onto the bulkhead 150 to secure the retaining block 130 in position against the bulkhead 150.

The apparatus 100 may further comprise a contact block 190 for positioning over the protruding ends of the terminals 120 to maintain connection between the terminals 120 and the sockets 180. The contact block 130 may have a generally cylindrical configuration and a plurality of specially designed holes 194 for accepting and retaining individual insulators 182 therein. The insulators 182 may accept and retain sockets 180 therein to maintain the sockets 180 in connection with the terminals 120. The first ends of the sockets 180 may be inserted about the second ends of the terminals, while the second end of the sockets 180 may be crimped about the electrical wires 164 collectively extending from a second multi-wired cable or a pigtail 166. The contact block 190 may also or alternatively provide insulation assurance in the area between the terminals 120 and the electrical wires 164. The contact block 190 may be secured to the bulkhead 150 by one or more fasteners 192.

One or more aspects of the apparatus 100 may allow gas trapped between the boots 110 and the retaining block 130 to escape upon expansion, while preventing (or at least discouraging) such expansion and/or escape from compromising the connections between the boots 110, the sockets 170, and the terminals 120. The area 148 defined between the inner surface 146 of the bell housing 140 and the surface 154 of the bulkhead 150 may also be partially or substantially filled with grease and/or other materials that, in some implementations, may aid in preventing pressurized well fluids from compromising the integrity of the electrical connections within the apparatus 100.

The apparatus 100 may further replace or supplement a conventional solder and heat shrink connection, which may simplify initial assembly and/or save time during cleaning and/or other servicing. The apparatus 100 may further aid in protecting against leakage and/or contamination of lubrication (e.g., grease). The apparatus 100 may be tailored to a specific downhole tool, such as may allow utilizing the apparatus 100 without significant (or any) modification to existing downhole tools, and may be utilized in wells exceeding about 22,000 feet (about 6700 meters) and/or about 17,000 psi, among others.

One or more methods of assembling the apparatus 100 may be as follows. First, the electrical wires 160 of the pigtail 162 may be inserted into a first opening 141 at a first end 142 of the bell housing 140, and then passed through corresponding holes 132 of the retaining block 130. The electrical wires 160 may then be passed through corresponding boots 110 and terminated, soldered, or otherwise connected to the corresponding sockets 170. The sockets 170 may then be fully seated within the corresponding boots 110 and the boots 110 may then be fully seated on the first ends of the terminals 120 to connect the sockets 170 with the terminals 120 and to maintain the connection therebetween. Alternatively, the sockets 170 may be connected to the terminals 120 first, and then the corresponding boots 110 may be fully seated over the sockets 170 and the terminals 120 to maintain the connection therebetween.

Thereafter, the retaining block 130 can be positioned about the boots 110 such that each wider portion 137 of the holes 132 accepts therein a corresponding boot 110. The retaining block 130 may then be inserted into the bell housing 140 through a second opening 143 in the bell housing 140. The second end 144 of the bell housing 140 may then be threadably engaged or otherwise connected to the bulkhead 150 to secure the retaining block 130 against the bulkhead 150. For example, the end 134 of the retaining block 130, opposite the bulkhead 150, may have a tapered surface 136 that may cooperate with a corresponding tapered internal surface 146 of the bell housing 140 to urge the retaining block 130 into abutment with a surface 154 of the bulkhead 150. When the retaining block 130 abuts the surface 154 of the bulkhead 150, the shoulder 135 of each hole 132 may abut the end surface 111 or other surface of each boot 110 to maintain the boot 110 in position. Each boot 110, in turn, maintains each socket 170 in contact with each terminal 120. By retaining the boots 110 in position, the retaining block 130 may also maintain the terminals 120 seated within the bulkhead 150.

Thereafter, electrical connection between the wires 164 and terminals 120 may be established. For example, the sockets 180 may be crimped onto the stripped ends of the wires 164 and then inserted into individual insulators 182 positioned within the holes 194 of the contact block 190. Thereafter, the contact block 190 may be positioned against the bulkhead 150 over the protruding second ends of the terminals 120, such that each socket 180 is positioned over and connected with each terminal 120. The contact block 190 may then be secured to the bulkhead 150 by one or more fasteners 192 to maintain the sockets 180 in connection with the terminals 120. It should be noted that the above steps may be performed in a different order.

Figure 5:
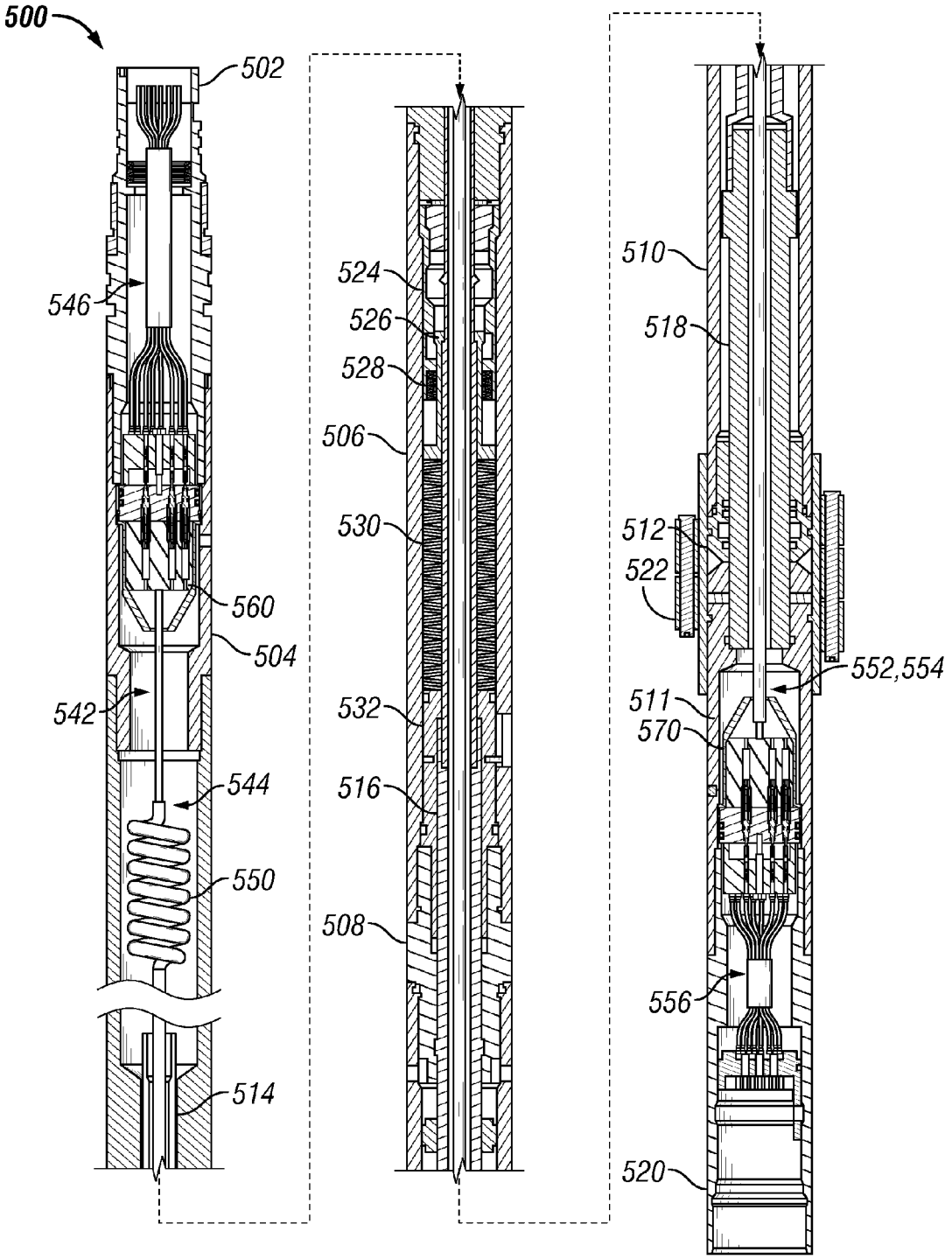
FIG. 5 is a schematic view of at least a portion of apparatus according to one or more aspects of the present disclosure.

FIG. 5 is a sectional view of at least a portion of a downhole tool 500 according to one or more aspects of the present disclosure. The downhole tool 500 may be is usable with the first and second connectors 560 and 570, which may be substantially similar to at least a portion of the apparatus 100 shown in FIGS. 1-4. However, the first and second connectors 560 and 570 may not be identical. The downhole tool 500 may be or comprise an impact jar utile in freeing apparatus that have become stuck in a wellbore. The diameter and/or other dimensions of the downhole tool 500 may substantially correspond to similar dimensions of the tool string (not shown) in which the downhole tool 500 is assembled, and/or the wellbore in which the downhole tool 500 and tool string may be conveyed via wireline, slickline, e-line, coiled tubing, and/or other conveyance means (not shown).

The downhole tool 500 comprises joint connections 502 and 520 at opposing ends operable to assemble the downhole tool 500 into the tool string. The downhole tool 500 also comprises a jarring assembly comprising, in order from top to bottom, an upper joint connection 502, an upper housing 504 coupled with the upper joint connection 502, an intermediate housing 506 coupled with the upper housing 504, a housing connector 508 coupled with the intermediate housing 506, a lower housing 510 coupled with the housing connector 508, and a stop 512 coupled with the lower housing 510. The downhole tool also comprises a static assembly comprising, in order from top to bottom, an upper mandrel 514, a lower mandrel 516 coupled with the upper mandrel 514, a shaft 518 coupled with the lower mandrel 516, an outer housing 511, and the lower joint connection 520 coupled with the shaft 518. The jarring and static assemblies are depicted as being coupled together by a clamp 522, which is removed prior to the downhole tool 500 being inserted into the wellbore. The downhole tool 500 also comprises a latch mechanism comprising an outer latch member 524, an inner latch member 526, a coil spring 528, a Belleville stack 530, and a biasing member 532 coupled with the housing connector 508. The outer latch member 524 is translated axially relative to the inner latch member 526 in response to axial translation of the intermediate housing 506. The inner latch member 526 translates axially relative to the outer latch member 524 in response to relative movement of the jarring and static assemblies and compression of the Belleville stack 530.

The downhole tool 500 may also comprise a sealed internal volume defined radially by an annulus that is defined between the lower housing 510 and the lower mandrel 516. The sealed volume may be defined axially between the stop 512 and a piston contained in the annulus that is defined between the lower housing and the lower mandrel. Various O-rings, seals, gaskets, wipers, and/or other sealing members may also exist at various locations within the downhole tool 500.

The downhole tool 500 may further comprise an electrical cable, jumper, or other assembly 550 spanning between a first connector 560 and a second connector 570. The first and second connectors 560 and 570 may be substantially similar to at least a portion of the apparatus 100 shown in FIGS. 1-4. However, the first and second connectors 560 and 570 may not be identical.

The first and the second connectors 560 and 570 may be positioned within the central cavity that extends through several components of the tool 500, including the upper housing 504, the intermediate housing 506, the housing connector 508, the lower housing 510, and the outer housing 511, all of which collectively make up the tool housing. FIG. 5 shows the first connector positioned within the central cavity 542 of the upper housing 504 and the second connector 570 positioned within the central cavity 552 of the outer housing. The first connector 560 may isolate the fluid side 544 of the jarring assembly from the dry side 546 of the jarring assembly, wherein the fluid side contains or is in contact with internal hydraulic fluid, lubricant, or other fluid, while the dry side does not contain hydraulic fluid, lubricant, or other fluid therein. Similarly, the second connector 570 may isolate the fluid side 554 of the static assembly from the dry side 556 of the static assembly.

The downhole tool 500 is assembled within a tool string (see FIG. 6), and is operable as follows. During normal operations, cantilevered "fingers" of the outer latch member 524 may be biased radially inward from their position shown in FIG. 5. If a portion of the tool string below the downhole tool 500 becomes stuck in the wellbore, a tensile force may be applied to the upper joint connection 502, such as by pulling on a wireline cable and/or other conveyance attached to the tool string. This tensile force urges the jarring assembly upwards relative to the static assembly. However, the Belleville stack juxtaposed between the biasing member and the inner latch member initially counteracts such relative movement of the jarring assembly, thus compressing the Belleville stack. As a result of the increasing tensile force applied to the upper joint connection, as well as the cooperation of surfaces and/or other features of the inner latch member, the outer latch member, the upper mandrel, and/or the intermediate housing, the ends of the cantilevered "fingers" of the outer latch member may deflect radially outward, thus freeing the jarring assembly to rapidly translate axially away from the static assembly. This results in an impact between mating shoulders of the stop and the shaft. This jarring force is transferred to the lower joint connection and, consequently, to the stuck portion of the tool string.

The downhole tool 500 may be actuated and/or deployed a number of times without being removed from the wellbore. For example, after the inner and outer latch members separate and allow the ensuing jarring force to be applied to the stuck portion of the tool string, relieving the tensile force applied to the upper joint connection may reengage the inner and outer latch members, such that the jarring process may be iterated in continued attempts to dislodge the tool string.

Figure 6:
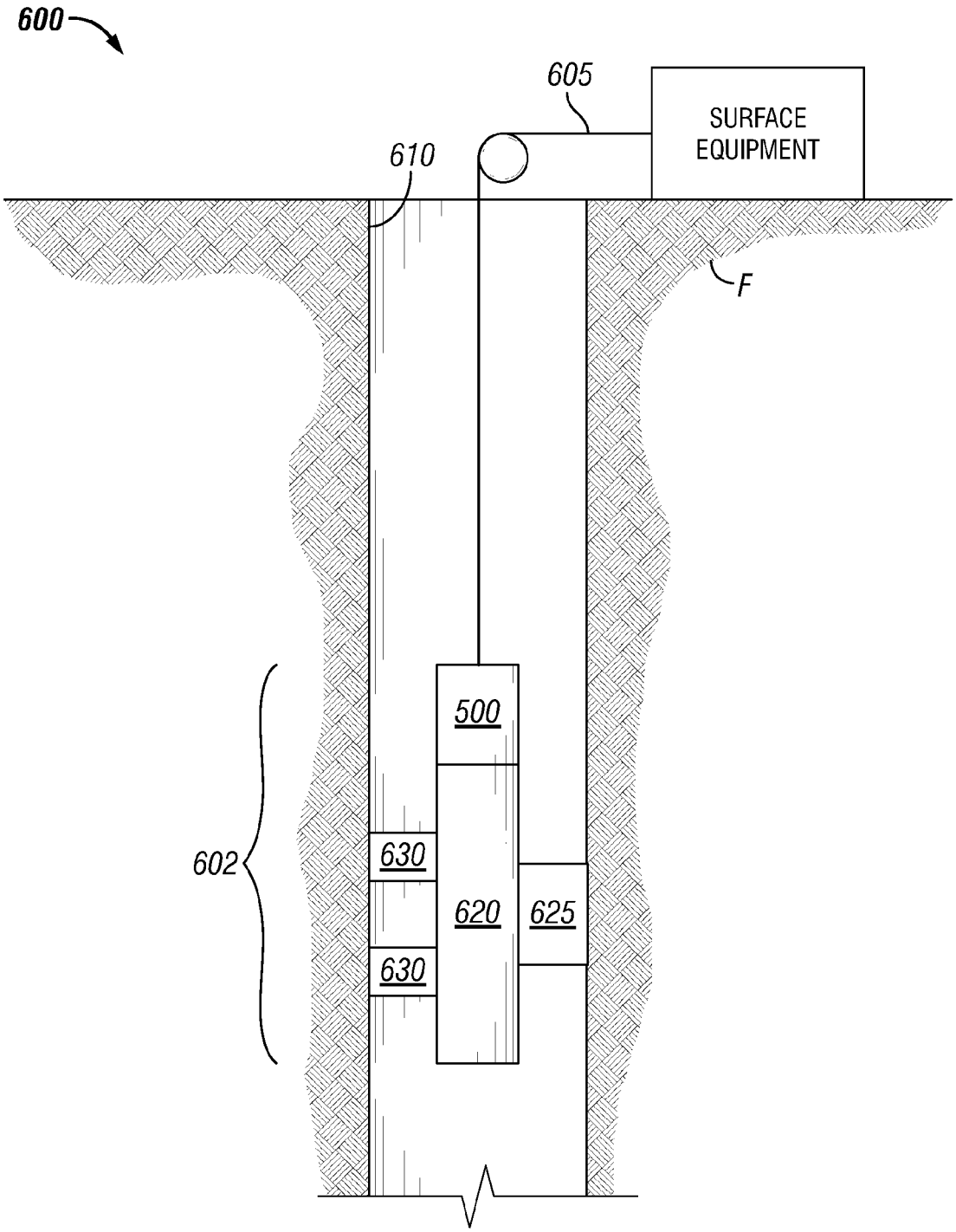
FIG. 6 is a schematic view of at least a portion of apparatus according to one or more aspects of the present disclosure.

FIG. 6 is a schematic view of an exemplary operating environment within the scope of the present disclosure, wherein the downhole tool 500 is suspended within a tool string 602 coupled to the end of a wireline, slickline, e-line, and/or other conveyance 605 at a wellsite having a borehole 610. The downhole tool 500 and/or conveyance 605 may be structured and/or arranged with respect to a service vehicle (not shown) and/or one or more surface equipment components at the wellsite. The example system 600 of FIG. 6 may be utilized for various downhole operations including, without limitation, those for and/or related to completions, conveyance, drilling, formation evaluation, reservoir characterization, and/or production, among others.

The system 600 comprises a downhole tool 620 that may be utilized for testing subterranean formations and/or analyzing composition of fluid(s) from a formation F. The downhole tool 620 may be coupled to the downhole tool 500, thus forming the tool string 602 (although the tool string 602 may comprise additional and/or alternative components within the scope of the present disclosure). The system 600 may also comprise associated telemetry/control devices/electronics and/or surface control/communication equipment. The downhole tool 620 is suspended in the borehole 610 at the lower end of the conveyance 605, which may be a multi-conductor logging cable spooled on a winch (not shown) at surface. The conveyance 605 may be electrically coupled to the surface equipment.

The downhole tool 620 may comprise an elongated body encasing and/or coupled to a variety of electronic components and/or modules that may be operable to provide predetermined functionality to the downhole tool 620. For example, the downhole tool 620 may comprise a static or selectively extendible apparatus 625, as well as one or more selectively extendible anchoring members 630 opposite the apparatus 625. The apparatus 625 may be operable to perform logging, testing, and/or other operations associated with the formation F, the wellbore 610, and/or fluids therein. For example, the apparatus 625 may be operable to selectively seal off or isolate one or more portions of a sidewall of the borehole 610 such that pressure or fluid communication with the adjacent formation F may be established, such as where the apparatus 625 may be or comprise one or more probe modules and/or packer modules.

FIG. 6 is provided as an example environment in which one or more aspects of the present disclosure may be implemented. However, in addition to the environment of FIG. 6, one or more aspects of the present disclosure may be applicable or readily adaptable for implementation in other environments utilizing other means of conveyance within the wellbore.

In view of all of the above and the figures, a person having ordinary skill in the art will readily appreciate that the present disclosure introduces an apparatus comprising: a bulkhead connector assembly for assembly within a downhole tool to isolate a dry side of the downhole tool from a fluid side of the downhole tool and to allow electrical communication therebetween, wherein the bulkhead connector assembly comprises: a bulkhead comprising a plurality of holes extending therethrough, wherein the bulkhead is adapted to form a fluid seal against an inside surface of the downhole tool; a plurality of terminals each extending through the bulkhead, wherein an end of each terminal is in electrical communication with a corresponding one of a plurality of electrical wires; a plurality of boots each extending about the end of a corresponding one of the plurality of terminals; a retaining block having a first end, a second end, and a plurality of holes each extending between the first and second ends and receiving a corresponding one of the plurality of boots, thereby positionally fixing each of the plurality of boots relative to the bulkhead; and a housing positioned around the retaining block and coupled to the bulkhead thus positionally fixing the retaining block relative to the bulkhead, wherein an opening of the housing receives the plurality of wires.

The retaining block may comprise a tapered edge operable to cooperate with a tapered inside surface of the housing and thereby urge the retaining block into centralized abutment with the bulkhead.

The housing may be threadably engageable with the bulkhead.

Each of the plurality of holes extending through the retaining block may comprise a narrower portion, a wider portion, and a shoulder extending therebetween, wherein each shoulder may abut an outer surface of a corresponding one of the plurality of boots.

The bulkhead connector assembly may further comprise a plurality of sockets each connected with the end of a corresponding one of the plurality of terminals, wherein each socket may electrically couple one of the plurality of wires with a corresponding one of the plurality of terminals.

The end of each terminal may be a first end, and the bulkhead connector assembly may further comprise a contact block abutting the bulkhead and having a first end, a second end, and a plurality of holes each extending between the first and second ends of the contact block and receiving a second end of a corresponding one of the plurality of terminals.

The plurality of sockets may be a plurality of first sockets. The plurality of wires may be a plurality of first wires. The bulkhead connector assembly may further comprise a plurality of second sockets each connected to the second end of a corresponding one of the plurality of terminals. Each of the plurality of second sockets may extend through a corresponding one of the plurality of holes extending through the contact block, and may be adapted for connecting with a corresponding one of a plurality of second wires. The contact block may be positionally fixed in abutment with the bulkhead, thereby fixing each of the plurality of second sockets in connection with the second end of a corresponding one of the plurality of terminals. The bulkhead connector assembly may further comprise a plurality of insulators each positioned about a corresponding one of the plurality of second sockets and the second end of a corresponding one of the plurality of terminals, thereby maintaining each of the plurality of second sockets in connection with the second end of the corresponding one of the plurality of terminals, and the contact block may positionally fix each of the plurality of insulators relative to the bulkhead.

The present disclosure also introduces a method comprising: assembling a bulkhead connector assembly by: inserting each of a plurality of terminals through a corresponding one of a plurality of holes extending through a bulkhead; connecting each of a plurality of electrical wires to an end of a corresponding one of the plurality of terminals; positioning each of a plurality of boots about the end of a corresponding one of a plurality of terminals and a portion of a corresponding one of the plurality of wires; positioning the plurality of boots, collectively, within a retaining block; and connecting a housing to the bulkhead around the retaining block, thus urging the retaining block into abutment with the bulkhead.

Positioning the plurality of boots within the retaining block may comprise inserting each of the plurality of boots into a corresponding one of a plurality of holes each extending into the retaining block.

Connecting each of the plurality of wires to the end of the corresponding one of the plurality of terminals may comprise: extending each wire through a corresponding one of the plurality of holes extending into the retaining block; then extending each wire through a corresponding one of the plurality of boots; and then connecting each wire to the end of the corresponding one of the plurality of terminals.

Connecting each of the plurality of wires to the end of the corresponding one of the plurality of terminals may comprise: extending each wire through a corresponding one of the plurality of holes extending into the retaining block; then extending each wire through a corresponding one of the plurality of boots; then connecting each wire to a corresponding one of a plurality of contact sockets; and then connecting each contact socket to the end of the corresponding one of the plurality of terminals.

The plurality of wires may be a plurality of first wires, the end of each of the plurality of terminals may be a first end, and assembling the bulkhead connector assembly may further comprise: connecting each of a plurality of second wires to a second end of a corresponding one of the plurality of terminals; and placing a contact block about the second end of the plurality of terminals, collectively.

The plurality of wires may be a plurality of first wires, the end of each of the plurality of terminals may be a first end, and assembling the bulkhead connector assembly may further comprise: connecting each of a plurality of second electrical wires to a corresponding one of a plurality of contact sockets; connecting each of the plurality of contact sockets with a second end of a corresponding one of a plurality of terminals; and placing the contact block about the second ends of the plurality of terminals, collectively, and the plurality of contact sockets, collectively, thus maintaining each of the plurality of contact sockets in connection with the second end of the corresponding one of the plurality of terminals.

The plurality of wires may be a plurality of first wires, the end of each of the plurality of terminals may be a first end, and assembling the bulkhead connector assembly may further comprises: connecting each of a plurality of second electrical wires to a corresponding one of a plurality of contact sockets; connecting each of the plurality of contact sockets with a second end of a corresponding one of a plurality of terminals; placing each of a plurality of insulators about the second end of a corresponding one of the plurality of terminals and a corresponding one of the plurality of contact sockets, thereby maintaining each of the plurality of contact sockets in connection with the second end of the corresponding one of the plurality of terminals; and placing the contact block about the plurality of insulators, collectively.

The method may further comprise assembling the bulkhead connector assembly into the downhole tool in a manner forming a fluid seal between the bulkhead and an inside surface of the downhole tool. Assembling the bulkhead connector assembly into the downhole tool may fluidly isolate a dry side of the downhole tool from a fluid side of the downhole tool and allow electrical communication between the dry and fluid sides.

The present disclosure also introduces a system comprising: a downhole tool comprising: a tool housing having a central cavity extending therethrough; and a bulkhead connector assembly positioned in the central cavity, wherein the bulkhead connector assembly fluidly isolates a dry side of the downhole tool from a fluid side of the downhole tool and allows electrical communication between the dry and fluid sides, and wherein the bulkhead connector assembly comprises: a bulkhead comprising a plurality of holes extending therethrough, wherein the bulkhead is adapted to form a fluid seal against an inside surface of the downhole tool; a plurality of terminals each extending through the bulkhead, wherein an end of each terminal is in electrical communication with a corresponding one of a plurality of electrical wires; a plurality of boots each extending about the end of a corresponding one of the plurality of terminals; a retaining block having a first end, a second end, and a plurality of holes each extending between the first and second ends and receiving a corresponding one of the plurality of boots, thereby positionally fixing each of the plurality of boots relative to the bulkhead; and a housing positioned around the retaining block and coupled to the bulkhead thus positionally fixing the retaining block relative to the bulkhead, wherein an opening of the housing receives the plurality of wires. The downhole tool may be a downhole impact jar tool.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same purposes and/or achieving the same advantages of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a bulkhead connector assembly for assembly within a downhole tool to isolate a dry side of the downhole tool from a fluid side of the downhole tool and to allow electrical communication therebetween, wherein the bulkhead connector assembly comprises:

a bulkhead comprising a plurality of holes extending therethrough, wherein the bulkhead is adapted to form a fluid seal against an inside surface of the downhole tool;

a plurality of terminals each extending through the bulkhead, wherein a first end of each terminal is in electrical communication with a corresponding one of a plurality of first electrical wires;

a plurality of boots each extending about the first end of a corresponding one of the plurality of terminals;

a retaining block having a first end, a second end, and a plurality of holes each extending between the first and second ends and receiving a corresponding one of the plurality of boots, thereby positionally fixing each of the plurality of boots relative to the bulkhead;

a housing positioned around the retaining block and coupled to the bulkhead thus positionally fixing the retaining block relative to the bulkhead, wherein an opening of the housing receives the plurality of first wires;

a plurality of first sockets each connected with the first end of a corresponding one of the plurality of terminals, wherein each first socket electrically couples one of the plurality of first wires with a corresponding one of the plurality of terminals;

a contact block abutting the bulkhead and having a first end, a second end, and a plurality of holes each extending between the first and second ends of the contact block and receiving a second end of a corresponding one of the plurality of terminals;

a plurality of second sockets each connected to the second end of a corresponding one of the plurality of terminals, wherein each of the plurality of second sockets extends through a corresponding one of the plurality of holes extending through the contact block and is adapted for connecting with a corresponding one of a plurality of second wires, and wherein the contact block is positionally fixed in abutment with the bulkhead thereby fixing each of the plurality of second sockets in connection with the second end of a corresponding one of the plurality of terminals; and a plurality of insulators each positioned about a corresponding one of the plurality of second sockets and the second end of a corresponding one of the plurality of terminals, thereby maintaining each of the plurality of second sockets in connection with the second end of the corresponding one of the plurality of terminals, wherein the contact block positionally fixes each of the plurality of insulators relative to the bulkhead.

2. The apparatus of claim 1 wherein the retaining block comprises a tapered edge operable to cooperate with a tapered inside surface of the housing and thereby urge the retaining block into centralized abutment with the bulkhead.

3. The apparatus of claim 1 wherein the housing is threadably engageable with the bulkhead.

4. The apparatus of claim 1 wherein each of the plurality of holes extending through the retaining block comprises a narrower portion, a wider portion, and a shoulder extending therebetween, wherein each shoulder abuts an outer surface of a corresponding one of the plurality of boots.

5. The apparatus of claim 1 wherein:

the retaining block comprises a tapered edge operable to cooperate with a tapered inside surface of the housing and thereby urge the retaining block into centralized abutment with the bulkhead;

the housing is threadably engageable with the bulkhead; and each of the plurality of holes extending through the retaining block comprises a narrower portion, a wider portion, and a shoulder extending therebetween, wherein each shoulder abuts an outer surface of a corresponding one of the plurality of boots.

6. A method, comprising:

assembling the bulkhead connector assembly of claim 1 by:

inserting each of the plurality of terminals through a corresponding one of the plurality of holes extending through the bulkhead;

connecting each of the plurality of first electrical wires to the first end of the corresponding one of the plurality of terminals;

positioning each of the plurality of boots about the first end of the corresponding one of the plurality of terminals and a portion of the corresponding one of the plurality of first wires;

positioning the plurality of boots, collectively, within the retaining block; and connecting the housing to the bulkhead around the retaining block, thus urging the retaining block into abutment with the bulkhead.

7. The method of claim 6 wherein positioning the plurality of boots within the retaining block comprises inserting each of the plurality of boots into the corresponding one of a plurality of holes each extending into the retaining block.

8. The method of claim 6 wherein connecting each of the plurality of first wires to the first end of the corresponding one of the plurality of terminals comprises:

extending each first wire through the corresponding one of the plurality of holes extending into the retaining block;

then extending each first wire through the corresponding one of the plurality of boots; and then connecting each first wire to the first end of the corresponding one of the plurality of terminals.

9. The method of claim 6 wherein connecting each of the plurality of first wires to the first end of the corresponding one of the plurality of terminals comprises:

extending each first wire through the corresponding one of the plurality of holes extending into the retaining block;

then extending each first wire through the corresponding one of the plurality of boots;

then connecting each first wire to the corresponding one of the plurality of first sockets; and then connecting each first socket to the first end of the corresponding one of the plurality of terminals.

10. The method of claim 6 wherein assembling the bulkhead connector assembly further comprises:

connecting each of the plurality of second wires to the second end of the corresponding one of the plurality of terminals; and placing the contact block about the second end of the plurality of terminals, collectively.

11. The method of claim 6 wherein assembling the bulkhead connector assembly further comprises:

connecting each of the plurality of second electrical wires to the corresponding one of the plurality of first sockets;

connecting each of the plurality of first sockets with the second end of the corresponding one of the plurality of terminals; and placing the contact block about the second ends of the plurality of terminals, collectively, and the plurality of first sockets, collectively, thus maintaining each of the plurality of first sockets in connection with the second end of the corresponding one of the plurality of terminals.

12. The method of claim 6 wherein assembling the bulkhead connector assembly further comprises:

connecting each of the plurality of second electrical wires to the corresponding one of the plurality of first sockets;

connecting each of the plurality of contact first sockets with the second end of the corresponding one of the plurality of terminals;

placing each of the plurality of insulators about the second end of the corresponding one of the plurality of terminals and the corresponding one of the plurality of first sockets, thereby maintaining each of the plurality of first sockets in connection with the second end of the corresponding one of the plurality of terminals; and placing the contact block about the plurality of insulators, collectively.

13. The method of claim 6 further comprising assembling the bulkhead connector assembly into the downhole tool in a manner forming a fluid seal between the bulkhead and an inside surface of the downhole tool.

14. The method of claim 13 wherein assembling the bulkhead connector assembly into the downhole tool fluidly isolates a dry side of the downhole tool from a fluid side of the downhole tool and allows electrical communication between the dry and fluid sides.

15. A system, comprising:

a downhole tool comprising:

a tool housing having a central cavity extending therethrough; and a bulkhead connector assembly positioned in the central cavity, wherein the bulkhead connector assembly fluidly isolates a dry side of the downhole tool from a fluid side of the downhole tool and allows electrical communication between the dry and fluid sides, and wherein the bulkhead connector assembly comprises:

a bulkhead comprising a plurality of holes extending therethrough, wherein the bulkhead is adapted to form a fluid seal against an inside surface of the downhole tool;

a plurality of terminals each extending through the bulkhead, wherein a first end of each terminal is in electrical communication with a corresponding one of a plurality of first electrical wires;

a plurality of boots each extending about the first end of a corresponding one of the plurality of terminals;

a retaining block having a first end, a second end, and a plurality of holes each extending between the first and second ends and receiving a corresponding one of the plurality of boots, thereby positionally fixing each of the plurality of boots relative to the bulkhead;

a housing positioned around the retaining block and coupled to the bulkhead thus positionally fixing the retaining block relative to the bulkhead, wherein an opening of the housing receives the plurality of first wires;

a plurality of first sockets each connected with the first end of a corresponding one of the plurality of terminals, wherein each first socket electrically couples one of the plurality of first wires with a corresponding one of the plurality of terminals;

a contact block abutting the bulkhead and having a first end, a second end, and a plurality of holes each extending between the first and second ends of the contact block and receiving a second end of a corresponding one of the plurality of terminals;

a plurality of second sockets each connected to the second end of a corresponding one of the plurality of terminals, wherein each of the plurality of second sockets extends through a corresponding one of the plurality of holes extending through the contact block and is adapted for connecting with a corresponding one of a plurality of second wires, and wherein the contact block is positionally fixed in abutment with the bulkhead thereby fixing each of the plurality of second sockets in connection with the second end of a corresponding one of the plurality of terminals; and a plurality of insulators each positioned about a corresponding one of the plurality of second sockets and the second end of a corresponding one of the plurality of terminals, thereby maintaining each of the plurality of second sockets in connection with the second end of the corresponding one of the plurality of terminals, wherein the contact block positionally fixes each of the plurality of insulators relative to the bulkhead.

16. The system of claim 15 wherein the downhole tool is a downhole impact jar tool.

17. An apparatus, comprising:

a bulkhead connector assembly for assembly within a downhole tool to isolate a dry side of the downhole tool from a fluid side of the downhole tool and to allow electrical communication therebetween, wherein the bulkhead connector assembly comprises:

a bulkhead comprising a plurality of holes extending therethrough, wherein the bulkhead is adapted to form a fluid seal against an inside surface of the downhole tool;

a plurality of terminals each extending through the bulkhead, wherein an end of each terminal is in electrical communication with a corresponding one of a plurality of electrical wires;

a plurality of boots each extending about the end of a corresponding one of the plurality of terminals;

a retaining block having a first end, a second end, and a plurality of holes each extending between the first and second ends and receiving a corresponding one of the plurality of boots, thereby positionally fixing each of the plurality of boots relative to the bulkhead; and a housing positioned around the retaining block and coupled to the bulkhead thus positionally fixing the retaining block relative to the bulkhead, wherein an opening of the housing receives the plurality of wires, and wherein:

the retaining block comprises a tapered edge operable to cooperate with a tapered inside surface of the housing and thereby urge the retaining block into centralized abutment with the bulkhead;

the housing is threadably engageable with the bulkhead;

each of the plurality of holes extending through the retaining block comprises a narrower portion, a wider portion, and a shoulder extending therebetween, wherein each shoulder abuts an outer surface of a corresponding one of the plurality of boots;

the bulkhead connector assembly further comprises a plurality of sockets each connected with the end of a corresponding one of the plurality of terminals, wherein each socket electrically couples one of the plurality of wires with a corresponding one of the plurality of terminals;

the end of each terminal is a first end and the bulkhead connector assembly further comprises a contact block abutting the bulkhead and having a first end, a second end, and a plurality of holes each extending between the first and second ends of the contact block and receiving a second end of a corresponding one of the plurality of terminals;

the plurality of sockets is a plurality of first sockets;

the plurality of wire is a plurality of first wires;

the bulkhead connector assembly further comprises a plurality of second sockets each connected to the second end of a corresponding one of the plurality of terminals;

each of the plurality of second sockets extends through a corresponding one of the plurality of holes extending through the contact block and is adapted for connecting with a corresponding one of a plurality of second wires;

the contact block is positionally fixed in abutment with the bulkhead thereby fixing each of the plurality of second sockets in connection with the second end of a corresponding one of the plurality of terminals;

the bulkhead connector assembly further comprises a plurality of insulators each positioned about a corresponding one of the plurality of second sockets and the second end of a corresponding one of the plurality of terminals, thereby maintaining each of the plurality of second sockets in connection with the second end of the corresponding one of the plurality of terminals; and the contact block positionally fixes each of the plurality of insulators relative to the bulkhead.

* * * * *